United States Patent [19]

Meyman

[11] 4,435,956

[45] Mar. 13, 1984

[54] BRACELET

[76] Inventor: Usher Meyman, 230 Ocean Pkwy., E3, Brooklyn, N.Y. 11218

[21] Appl. No.: 320,420

[22] Filed: Nov. 12, 1981

[51] Int. Cl.[3] ..... F16G 13/00

[52] U.S. Cl. ..... 59/79.1; 59/79.3; 63/5 A

[58] Field of Search ..... 59/79 R, 79 A, 79 B; 63/5 A, 11; 224/179, 164, 79.1, 79.2, 79.3; D11/19, 20

[56] References Cited

U.S. PATENT DOCUMENTS 1,567,640 12/1925 Guyot ..... 59/79 A 3,203,200 8/1965 Inotsume ..... 59/79 R

FOREIGN PATENT DOCUMENTS 1005278 4/1952 France ..... 59/79

*Primary Examiner*—Francis S. Husar

*Assistant Examiner*—David B. Jones

*Attorney, Agent, or Firm*—Ilya Zborovsky

[57] ABSTRACT

A bracelet, for example, for a watch has two spring elements arranged in two longitudinal rows and connected with one another by a plurality of transverse connecting elements. The connecting elements may overlap one another. The bracelet may be made of a one piece blank by stamping and subsequent bending of respective parts thereof.

6 Claims, 6 Drawing Figures

BRACELET

BACKGROUND OF THE INVENTION

The present invention relates to a bracelet. More particularly, it relates to a bracelet for watches.

Bracelets, particularly bracelets for watches are known in the art and widely utilized. There are bracelets which are used for decoration purposes and include a spiral spring. Such a bracelet is more convenient to put on and to put off than a non-stretchable bracelet. It, however, possesses the disadvantage in the fact that such a bracelet catches hairs on an arm and causes painful feeling. There are also bracelets which have a spiral spring with preliminarily stretched coils. They are not widely used because their supporting surface is small and their appearance is not attractive as a result of gaps between the coils.

SUMMARY OF THE INVENTION

Accordingly, it is an object of the present invention to provide a bracelet, such as a bracelet for a watch, which avoids the disadvantages of the prior art.

More particularly, it is an object of the present invention to provide a bracelet which is convenient in use and has an attractive appearance.

In keeping with these objects and with others which will become apparent hereinafter, one feature of the present invention resides, briefly stated, in a bracelet which has two elongated spring elements arranged in two rows, and a plurality of connecting elements which connect said spring elements with one another in a transverse direction. When a bracelet is designed in accordance with the present invention, it avoids the above-mentioned disadvantages.

In accordance with another feature of the present invention, the connecting element may be arranged so that they overlap each other.

Still another feature of the present invention is that the spring elements may be zig-zag-shaped.

A further feature of the present invention is that the whole bracelet may be manufactured from a one piece blank by stamping and bending.

The novel features of the present invention which are considered characteristic for the invention are set forth in the appended claims. The invention itself, however, will be best understood from the following description which is accompanied by the following drawings.

DESCRIPTION OF PREFERRED EMBODIMENTS

A bracelet in accordance with the present invention has two spring elements 1 (FIGS. 1 and 2) which are zig-zag shaped and are connected with one another by a plurality of connecting elements, fixedly connected to said spring, each having two lateral covers 3 and a bridge part 2 connecting the covers 3 with one another.

Figure 3:
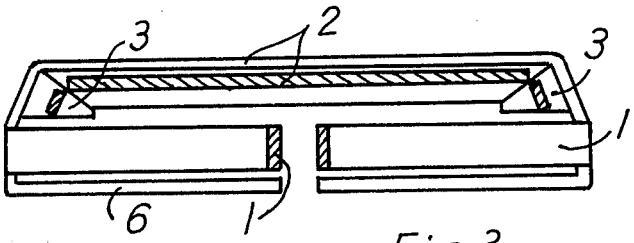
FIG. 3 is a view showing a transverse cross-section with supporting portions.

When the bracelet is to be used for a watch, it can be formed of two symmetrical halves each having two spring elements and connected by an insert 4, as well as having ears 5. More than one such insert may be utilized. The bracelet may be provided with supporting plates or portions 6 shown in FIG. 3. The bridge parts 2 have bent end sections which are formed, for example, as equilateral trapezii. The lateral covers 3 are of a substantially triangular shape. The bridge parts and the lateral covers of neighboring connecting elements overlap each other like scales, but, however, do not contact with each other. The overlap is such that even in the event of considerable stretching, gaps do not appear either above or at the sides. This allows the making of the bracelet with considerable initial gaps between the elements movable relative to one another, and of when the spring returns after stretching the gaps do not decrease and therefore, no catching of hair in the bracelet takes place.

Figure 4:
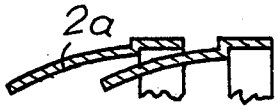
FIG. 4 is a view showing an embodiment of a bridge portion of a connecting element.

Bridge parts **2*a* which is shown in FIG. 4** can be bent in accordance with an arc, which prevents catching of hairs between them and during bending about the arm. This is because during this, the bridge parts displace relative to one another along an arc corresponding to the contour of the arm, i.e. along the arc of a relatively great diameter.

The spring elements may be composed of steel strips, whereas the connecting elements may be composed of a decorative material, for example, of gold.

Figure 5:
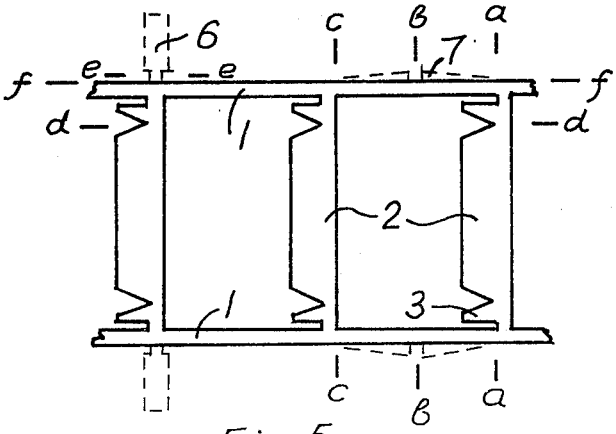
FIG. 5 is a view showing a part of a blank for manufacturing the inventive bracelet.

When the bracelet is formed without the supporting plates 6, the spring elements may be provided with straps 7 which are shown in dashed lines in FIG. 5. The straps 7 after bending increase the supporting surface of the spring elements.

Figure 1:
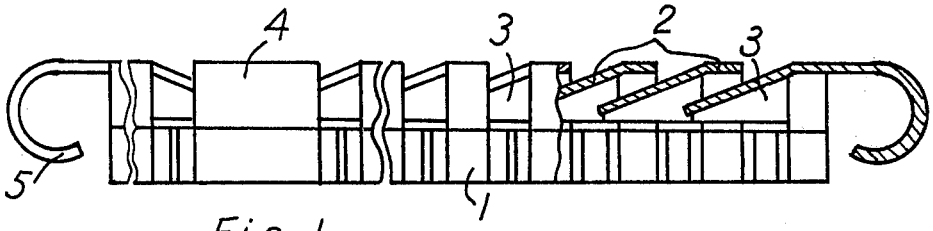
FIG. 1 is a view showing a bracelet in accordance with the present invention, partially sectioned.
Figure 2:
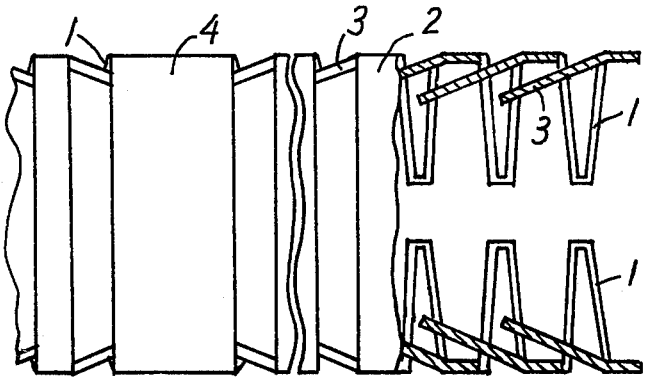
FIG. 2 is a plan view showing a broken out section of the inventive bracelet.

The bracelet may be manufactured from a one-piece blank shown in FIG. 5. The blank has a plurality of sections each having at least two strips 1 which will form the spring element, two small projections 3 which will form the lateral covers between the strips, and one big projection 2 between two small projections to form bridge parts. The blank can be made by stamping or rolling between rolls with formation of required cutouts and subsequent bending of all parts simultaneously or in the following sequence:

along the lines a-a with lowering of free edges of the bridge part 2 and lateral covers 3 down (in order to obtain the required angles of inclination as shown in FIGS. 1 and 2);

along the lines b-b with lowering down, and the spring elements are simultaneously bent along the lines c-c and a-a and become zig-zag shaped so that the lines c-c run in the plane of drawing together with the lines a-a so that the bridge parts 2 and the lateral covers 3 overlap one another in neighboring sections;

along the lines d-d, so that the lateral covers are lowered down, and the spring elements assume horizontal position.

Bending of the ears 5 can be performed simultaneously with any of the above listed steps. When the bracelet is formed with the supporting plates 6 shown in FIG. 5 by dashed lines, or with the straps 7, bending along the lines e-e or the lines f-f with lowering of the edges of the plates 6 or the straps 7 is performed before the above listed steps or simultaneously therewith.

Figure 6:
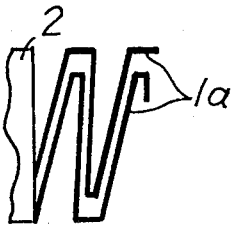
FIG. 6 is a view showing a further embodiment of a spring element.

In the event of increase of the distance between the lines a-a and c-c, spring elements 1*a* shown in FIG. 6 can be bent assymetrically with the offset appexes, so that the zig-zags of one spring element are arranged between the zig-zags of the other spring element. By selection of the length of the zig-zags, it is possible to adjust the stiffness of the spring elements, i.e. of the bracelet, and also to adjust the supporting area so that the plates 6 or the straps 7 can be dispensed with.

The invention is not limited by the details shown, since various modifications and structural changes are possible without departing in any way from the spirit of the present invention.

What is intended to be protected by Letters Patent is set forth in particular in the appended claims.

I claim:

1. A bracelet, comprising two spring elements arranged in two rows extending in direction of elongation; and a plurality of connecting elements arranged in overlapping relationship and connecting said spring elements in a direction which is transverse to said direction of elongation and fixedly connected with said spring elements.

2. A bracelet as defined in claim 1, wherein said spring elements extend substantially parallel to one another.

3. A bracelet as defined in claim 1, wherein each of said connecting elements have two lateral covers and a bridge part connecting said lateral covers with one another.

4. A bracelet as defined in claim 4, wherein each of said lateral covers have a straight portion and an inclined portion.

5. A method of manufacturing a bracelet having two spring elements arranged in two rows extending in direction of elongation, and a plurality of connecting elements arranged to connect the spring elements in a direction which is transverse to the direction of elongation, comprising the steps of stamping a one piece blank for the whole bracelet; and bending parts of the one-piece blank so as to form said spring elements and said connecting elements.

6. A method as defined in claim 6, wherein each of the connecting elements includes two lateral covers spaced from one another in the transverse direction and a bridge part connecting the latter with one another, said stamping step including forming in the one-piece blank a plurality of sections each having two longitudinal strips spaced from one another in a transverse direction, two small projections also spaced from one another in the transverse direction and located between the two strips, and one big projection located between the two small projections, said bending step including bending each of said two strips so as to form one of the spring elements from each of said strips and to form the bridge part from each of said big projections, and bending said small projection so as to form the lateral covers.

* * * * *